US006627262B1

(12) United States Patent
Soas et al.

(10) Patent No.: US 6,627,262 B1
(45) **Date of Patent: *Sep. 30, 2003**

(54) METHOD AND DEVICE FOR CONTINUOUSLY COATING AT LEAST A METAL STRIP WITH A CROSSLINKABLE POLYMER FLUID FILM

(75) Inventors: Thierry Soas, Chantilly (FR); Claude Bonnebat, Pontault Combault (FR); Frédéric Jenny, Chantilly (FR)

(73) Assignee: Sollac, Puteaux (FR)

( * ) Notice: Subject to any disclaimer, the term of this patent is extended or adjusted under 35 U.S.C. 154(b) by 0 days.

This patent is subject to a terminal disclaimer.

(21) Appl. No.: 09/857,970

(22) PCT Filed: Dec. 7, 1999

(86) PCT No.: PCT/FR99/03041

§ 371 (c)(1),
(2), (4) Date: Jun. 13, 2001

(87) PCT Pub. No.: WO00/35594

PCT Pub. Date: Jun. 22, 2000

(30) Foreign Application Priority Data

Dec. 16, 1998 (FR) ..... 98 15900

(51) Int. Cl.[7] ..... B05D 1/28; B05C 1/08

(52) U.S. Cl. ..... 427/318; 427/358; 427/421; 427/422; 427/424; 427/428; 118/68; 118/60; 118/202; 118/249; 118/261; 118/258; 118/259; 156/324; 156/324.4; 156/555; 264/171.14; 264/171.21; 264/171.22

(58) Field of Search ..... 427/318, 358, 427/428, 421, 422, 424; 118/68, 60, 202, 249, 261, 259, 258; 156/324, 324.4, 555; 264/171.14, 171.21, 171.22

(56) References Cited

U.S. PATENT DOCUMENTS

| | | | | | |
|---|---|---|---|---|---|
| 4,267,215 | A | * | 5/1981 | Riggs | 427/372.2 |
| 4,957,423 | A | * | 9/1990 | Yokoya | 118/211 |
| 5,318,804 | A | * | 6/1994 | Yoshida | 118/409 |
| 5,407,702 | A | | 4/1995 | Smith et al. | |
| 5,677,008 | A | * | 10/1997 | Kameya et al. | 427/428 |

FOREIGN PATENT DOCUMENTS

| | | | |
|---|---|---|---|
| DE | 21 66 968 | | 7/1977 |
| EP | 0 550 918 | | 7/1993 |
| WO | WO 93 19938 | | 10/1993 |
| WO | WO 99/07480 | * | 2/1999 |

* cited by examiner

*Primary Examiner*—Katherine A. Bareford
(74) *Attorney, Agent, or Firm*—Sughrue Mion, PLLC

(57) ABSTRACT

A method and device for continuously coating at least a metal strip (1) with a crosslinkable polymer fluid film which is free of non-reactive solvent or diluent, and which has a softening temperature higher than 50° C. The method includes the steps of: continuously unwinding the metal strip (1) on at least a back-up roll (30); forming, by forced flow on an applicator roll (20) having a deformable surface, a layer of the crosslinkable polymer; and forming on the applicator roll (20) the crosslinkable polymer film and transferring the film from the applicator roll onto the metal strip. The device implements this method.

29 Claims, 3 Drawing Sheets

METHOD AND DEVICE FOR CONTINUOUSLY COATING AT LEAST A METAL STRIP WITH A CROSSLINKABLE POLYMER FLUID FILM

This application is a national stage application of PCT/FR99/03041, filed Dec. 7, 1999.

BACKGROUND OF THE INVENTION

The subject of the present invention is a process and an apparatus for the continuous coating of at least one metal strip with a thin fluid film of crosslinkable polymer containing neither non-reactive solvent nor diluent.

Thermally crosslinkable polymers such as, for example, thermosetting polymers, or physically crosslinkable polymers such as, for example, photocurable polymers, are known.

There is a wide variety of thermosetting organic coatings which are continuously applied to metal substrates.

In most cases, these are complex formulations which combine, in a solvent or aqueous medium, a system of prepolymer functional organic binders, a crosslinking system and additives, such as pigments or fillers, various formulation adjuvants.

Various processes are also known for applying a thermoplastic or thermosetting organic coating to a bare or coated metal strip.

The application of organic coatings such as, for example, liquid paints or varnishes is usually carried out by roller coating these liquid coatings in the state of a solution or of a dispersion in an aqueous or solvent medium.

To do this, the liquid coating is deposited on a metal strip by predosing the solution or dispersion using a system comprising two or three rollers and by transferring some or all of this liquid coating thus predosed onto an applicator roller in contact with the surface of the metal strip to be coated.

The transfer is performed either by friction of the applicator roller on the metal strip, the two surfaces in contact running in opposite directions, or by contact in the same direction.

An advantageous trend in the technology of continuous application of crosslinkable polymer coatings, such as thermosetting paints or varnishes for example, to a metal strip consists in depositing this coating without the use of a solvent or a diluent.

Several alternatives have been proposed for producing and applying organic coatings without the use of a non-reactive solvent or diluent.

However, the processing poses two problems, namely that of producing a homogeneous dispersion of the fillers and pigments in the binder system and that of applying the product thus obtained.

One of the techniques used for applying such coatings consists in applying the organic coating in the form of a powder.

Another technique for applying a liquid coating to a metal strip is known, this technique using a heating tank, usually called a melting kettle, provided in its lower part with an orifice from which the liquid polymer contained in the tank flows.

Placed below this tank are two parallel rolls in contact with each other and the metal strip to be coated moves along beneath these rolls.

The liquid polymer is poured into the nip of the rolls, then flows between the said rolls and is deposited on the metal strip.

However, this technique has drawbacks stemming from the fact that the polymer can be only slightly reactive on account of its relatively long storage time in the heating tank and from the fact that it does not allow the thickness of the coating film on the metal strip to be controlled and consequently does not allow a thin homogeneous coating to be obtained.

To produce thin coatings of viscous organic products, another technique consists in using the extrusion of the organic coating in the fluid state and in applying this coating to a substrate by extrusion coating or by lamination.

It is common practice to apply a thin organic coating, particularly of thermoplastic polymers, by extrusion coating to flexible substrates, such as paper, plastic films, textiles or even thin metal substrates, such as packaging materials.

The molten coating is applied by means of a rigid sheet die or of a nozzle positioned in direct contact with the substrate.

The pressure exerted by the die on the substrate derives from the viscosity of the melt. Thus, any possibility of correcting the discrepancies in flatness of the substrate, by pressing the latter against the back-up roll, is very limited.

This extrusion lamination technique requires there to be strict parallelism between the edges of the die and the substrate, and this substrate must either be perfectly plane or deformable, in order to allow the formation of a thin coating of uniform thickness.

This is because the thickness of material deposited is controlled by the gap and the pressure between the die and the substrate, thereby imposing strict parallelism between these two elements when it is desired to apply very small thicknesses.

This condition cannot be met in the case of steel strip having a thickness of between 0.3 and 2 mm, which is too rigid and has an insufficient flatness or thickness uniformity to allow such precise adjustment of the gap between the die and the substrate, particularly in the case of wide strip.

The technique of extrusibn-laminating a uniform layer of fluid coating on a substrate uses the drawing, beneath the die, of a fluid sheet at the exit of a sheet die, this sheet then being pressed against the substrate with the aid, for example, of a cold roller or of a rotating bar, or else by an air knife or an electrostatic field.

In this case, the thickness of the fluid sheet is controlled by the flow rate of the material in the die section and by the speed of the substrate.

In the event of the fluid sheet sticking to the press roll, the sheet would then separate into two parts within its thickness, one part being applied to the substrate and the other part remaining applied to the roll. This separation of the sheet therefore means that the transfer is not complete and the coating obtained on the substrate does not have a satisfactory surface appearance nor a uniform thickness.

In order to prevent the fluid sheet from sticking on the pressing roller, the latter must have a perfectly smooth and cooled surface.

The pressing pressure must however be low enough to prevent the formation of a calendering bead and consequently, this mode of transfer does not make it possible to compensate for any thickness variations and discrepancies in flatness in the case of a rigid substrate.

This technique of applying the coating with the formation of a free strand at the exit of the extrusion die makes it possible to avoid the problems of coupling between the die and the rigid substrate, but it causes application instabilities if the length of the free strand fluctuates and it is difficult to carry out with thermosetting systems having a viscosity of less than 2000 Pa.s because of the difficulties in achieving uniform drawing and good pressing.

In general, in the various known techniques mentioned above, the continuous application of a thin organic coating to metal substrates is carried out with low contact pressures, insufficient to allow production of a thin uniform coating applied homogeneously to rigid substrates which may have flatness and thickness-heterogeneity discrepancies.

These various application techniques do not make it possible to compensate for the variations in thickness of the metal substrate, which variations consequently cause unacceptable fluctuations in the thickness of the coating, especially if the substrate is formed by a metal strip which exhibits significant surface roughness and/or corrugations of amplitude equal to or greater than the thickness of the coating to be produced on the said metal strip.

Moreover, these various application techniques do not make it possible to allow for variations in the width of the substrate nor variations in the transverse positioning of this substrate, so that the coating cannot be deposited uniformly over the entire width of the substrate.

Finally, during application of the coating, air microbubbles may be trapped between the coating and the substrate, which is to the detriment of homogeneous application and to the surface appearance of this coating.

Thus, the continuous application of a thin uniform coating of crosslinkable polymer to a metal strip therefore causes problems because this metal strip has flatness and thickness discrepancies as well as significant roughness and/or corrugations of amplitude equal to or greater than the thickness of the coating film to be deposited on the said strip, even when this strip is pressed with a high force against a uniform roll.

In addition, the various techniques used hitherto do not make it possible to apply, to a metal strip, a thin coating of crosslinkable polymer containing neither non-reactive solvent nor diluent, meeting two contradictory requirements, namely hardness and deformability.

This is because, after crosslinking, the polymer coating must be sufficiently hard while still being deformable in order to allow the forming of metal sheet thus coated without causing degradation or debonding of the coating.

Now, it is known that increasing the molecular mass of the crosslinkable precursors of the polymer is highly favourable to obtaining a final coating which is both hard and deformable.

However, increasing the molecular mass of the precursors has a very unfavourable effect on the viscosity of a polymer containing neither non-reactive solvent nor diluent, this not being favourable to transfer and application of the sheet onto the metal

SUMMARY OF THE INVENTION

The object of the invention is to avoid these drawbacks by providing a process and an apparatus for the continuous coating of at least one metal strip with a thin fluid film of crosslinkable polymer containing neither non-reactive solvent nor diluent, and the softening temperature of which is higher than 50° C., making it possible to obtain a coating of uniform thickness of a few microns to a few tens of microns applied homogeneously to this strip, while preventing air microbubbles from being trapped between the film and the metal strip and obviating discrepancies in the flatness and roughness of this strip as well as allowing application on part or all of the coating, despite the fluctuations in width and transverse positioning of this strip. The subject of the invention is therefore a process for the continuous coating of at least one metal strip with a fluid film of crosslinkable polymer containing neither non-reactive solvent nor diluent and the softening temperature of which is higher than 50° C, the said film having a thickness of less than that of the metal strip, characterized in that:

- the metal strip is made to run continuously over at least one back-up roll;
- a sheet of the said crosslinkable polymer is formed, by forced flow at a temperature above the softening temperature of the crosslinkable polymer, on an applicator roll having a deformable surface, the said crosslinkable polymer having a melt viscosity greater than 10 Pa.s under the conditions of formation of the said sheet, the temperature of formation of this sheet being below the crosslinking onset temperature of the crosslinkable polymer and the said applicator roll being driven in rotation in the opposite direction to the direction in which the metal strip runs;
- the crosslinkable polymer film is formed on the applicator roll;
- the film is transferred, thicknesswise, from the applicator roll onto the metal strip, by compressing this metal strip between the back-up roll and the applicator roll, in order to obtain a coating of homogeneous thickness.

The subject of the invention is also an apparatus for the continuous coating of at least one metal strip with a fluid film of crosslinkable polymer containing neither non-reactive solvent nor diluent and the softening temperature of which is higher than 50° C, the said film having a thickness of less than that of the metal strip, characterized in that it comprises:

- means for continuously driving the metal strip;
- at least one back-up roll supporting the metal strip;
- means for forming, on an applicator roll having a deformable surface, by forced flow at a temperature greater than the softening temperature of the crosslinkable polymer, a sheet of the said crosslinkable polymer having a melt viscosity greater than 10 Pa.s under the conditions of formation of the said sheet, the formation temperature of this sheet being below the crossslinking onset temperature of the crosslinkable polymer and the said applicator roll being driven in rotation in the opposite direction to the direction in which the metal strip runs and forming the crosslinkable polymer film;
- and means for compressing the metal strip between the back-up roll and the applicator roll in order to completely transfer, thicknesswise, the said film from the applicator roll onto the metal strip and to obtain a coating of homogeneous thickness.

BRIEF DESCRIPTION OF THE DRAWINGS

The features and advantages of the invention will emerge during the description which follows, given solely by way of example and with reference to the appended drawings in which.

DETAILED DESCRIPTION OF THE INVENTION

Figure 1:
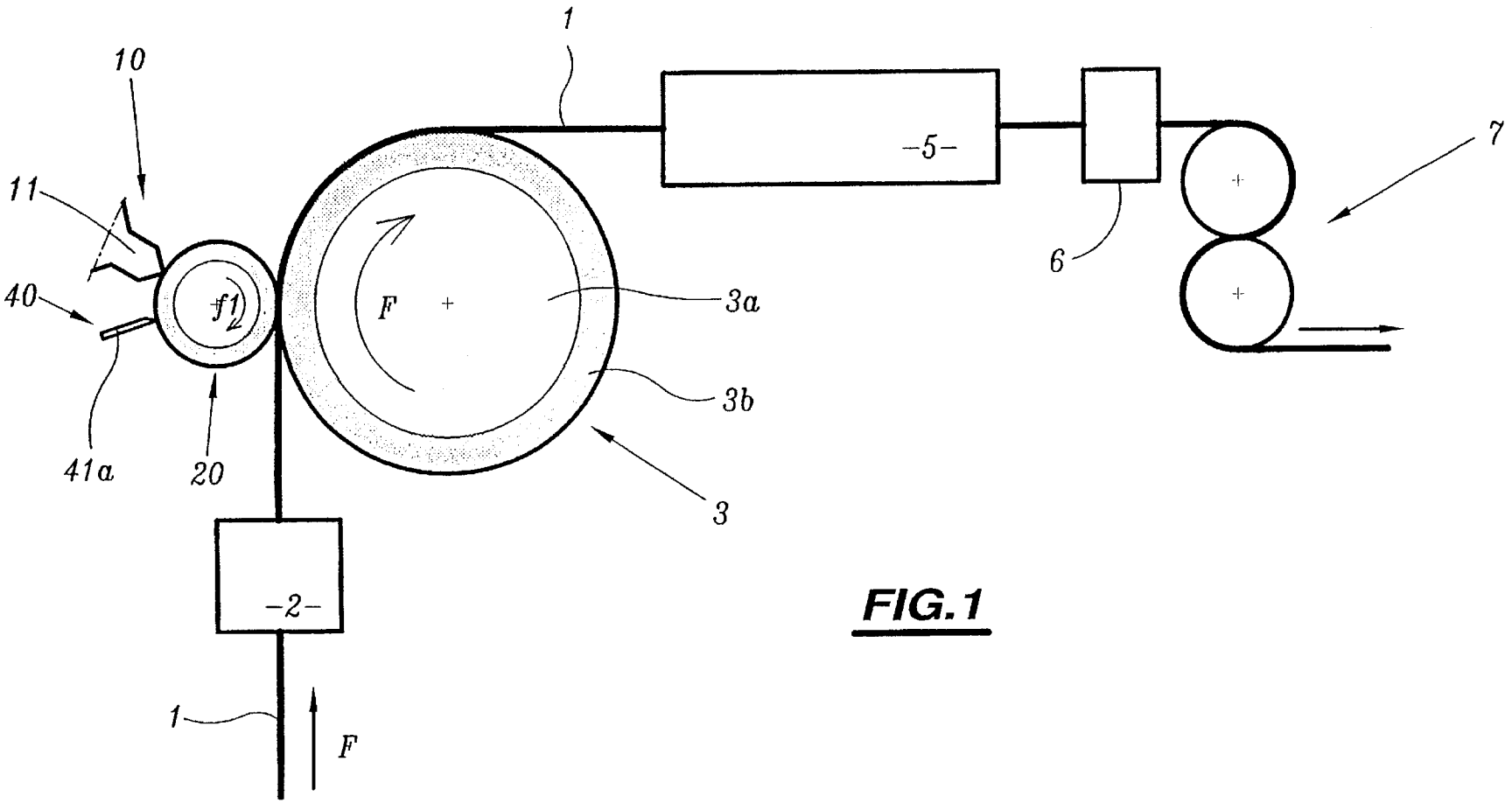
- FIG. 1 is a schematic cross-sectional view of a plant for coating a metal strip with a film of crosslinkable polymer, comprising an apparatus for applying this coating, according to the invention.

FIG. 1 shows schematically a plant for the continuous coating of a metal strip 1 with a film of fluid crosslinkable polymer containing neither non-reactive solvent nor diluent and with a thickness of, for example, between 5 and 5 $\mu$m.

This metal strip has a thickness of, for example, between 0.10 and 4 mm and is, for example, made of steel or aluminium or of an aluminium alloy and can be coated or prepainted on one or both of its sides.

The polymer used to coat the metal strip 1 is a polymer containing neither non-reactive solvent nor diluent and is thermally crosslinkable, such as a thermosetting polymer for example, or physically crosslinkable, such as a photocurable polymer for example. In the uncrosslinked state, this polymer has a softening temperature higher than 50° C.

These polymers have softening, flow-onset, crosslinking-onset and rapid-crosslinking temperatures which are different.

In general, the crosslinking-onset temperature is the temperature above which an increase in the viscosity of more than 10% is observed in less than 15 minutes.

In the illustrative example shown in FIG. 1, the metal strip 1 is driven so as to run in the direction of the arrow F and this metal strip 1 bears against at least one back-up roll 3 comprising a central core 3*a* made of metal, such as for example steel, and an external jacket 3*b* made of deformable material, such as an elastomer for example.

The back-up roll 3 may also consist of a steel roll.

The plant includes means 2 for preheating the metal strip 1 to a temperature approximately equal to or greater than the temperature of the fluid film of crosslinkable polymer to be deposited on the said metal strip 1 and equal to or greater than the softening temperature of this crosslinkable polymer.

The means 2 for preheating the metal strip 1 consist, for example, of at least one induction furnace.

As shown in FIG. 1, the plant also includes, from the upstream end to the downstream end:

- a device denoted in its entirety by the reference 10, for coating the metal strip 1 with a film of fluid crosslinkable polymer containing neither non-reactive solvent nor diluent and the softening temperature of which is higher than 50° C.;
- means 5 for curing or crosslinking the film of crosslinkable polymer;
- and a unit 7 for hauling off the metal strip 1.

If the polymer is thermally crosslinkable, the curing means 5 comprise, for example, at least one induction oven and cooling means 6, and if the polymer is physically crosslinkable, the curing means 5 may consist of ultraviolet lamps or of electron beams.

The apparatus 10 for coating the metal strip 1 with a film of fluid crosslinkable polymer will now be described with reference to FIGS. 2 and 3.

This film of crosslinkable polymer to be deposited on the metal strip 1 must be of uniform thickness, even though this metal strip 1 has thickness heterogeneities or flatness discrepancies as well as significant surface roughness and/or corrugations of amplitude equal to or greater than the thickness of the film deposited on the said metal strip 1.

The coating apparatus 10 comprises:

- means 11 and 12 for forming, on an applicator roll 20 having a deformable surface, by forced flow, a homogeneous and uniformly thick sheet 30 of crosslinkable polymer having a viscosity greater than 10 Pa.s and preferably between 20 Pa.s and 2000 Pa.s under the conditions of formation of the said sheet 30, the said applicator roll 20 forming a film 31 of crosslinkable polymer with a uniform thickness approximately equal to the desired thickness;
- and means for compressing the metal strip 1 between the back-up roll 3 and the applicator roll 20 in order to completely transfer, thicknesswise, the said film 31 from the applicator roll 20 onto the metal strip 12 and to obtain a coating of homogeneous thickness.

A transfer is regarded as being total or almost total, thicknesswise, when more than 90% of the material has been transferred.

The sheet 30 is formed by forced flow at a temperature above the softening temperature of the crosslinkable polymer.

In addition, the temperature of formation of the sheet 30 is below the crosslinking-onset temperature of the polymer.

The means for forming, by forced flow, the sheet 30 of crosslinkable polymer comprise for example an extruder, not shown, of conventional type, provided with a die 11 having an extrusion slot 12 and a flow regulator, not shown, consisting, for example, of a metering pump placed between the extruder and the die 11.

The applicator roll 20 comprises a central core 21 made of metal, such as for example steel, and an external jacket 22 made of deformable material, such as an elastomer for example.

Figure 2:
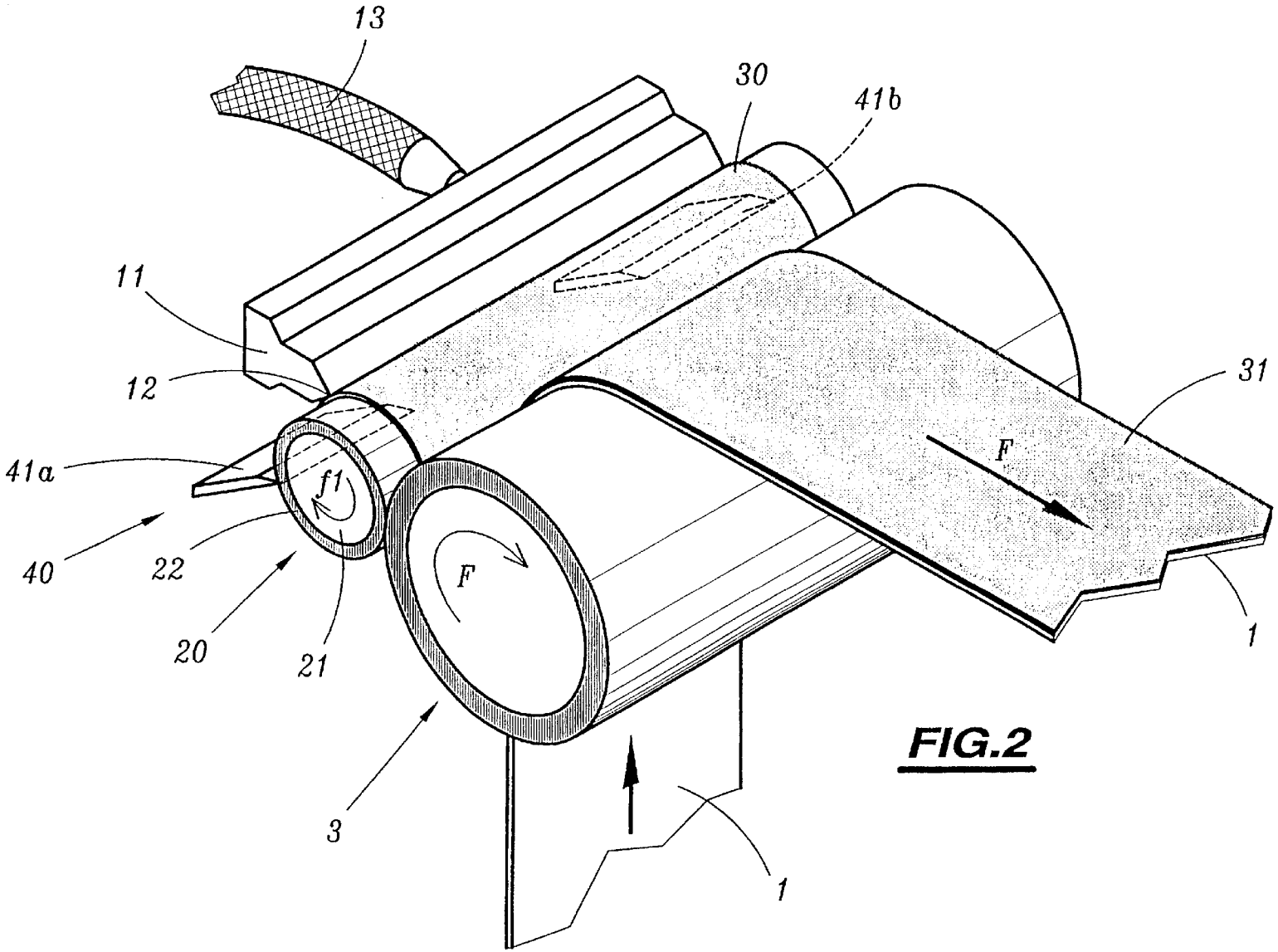
- FIG. 2 is a schematic perspective view of the application apparatus according to the invention and provided with a first embodiment of means for removing the excess crosslinkable polymer.
Figure 3:
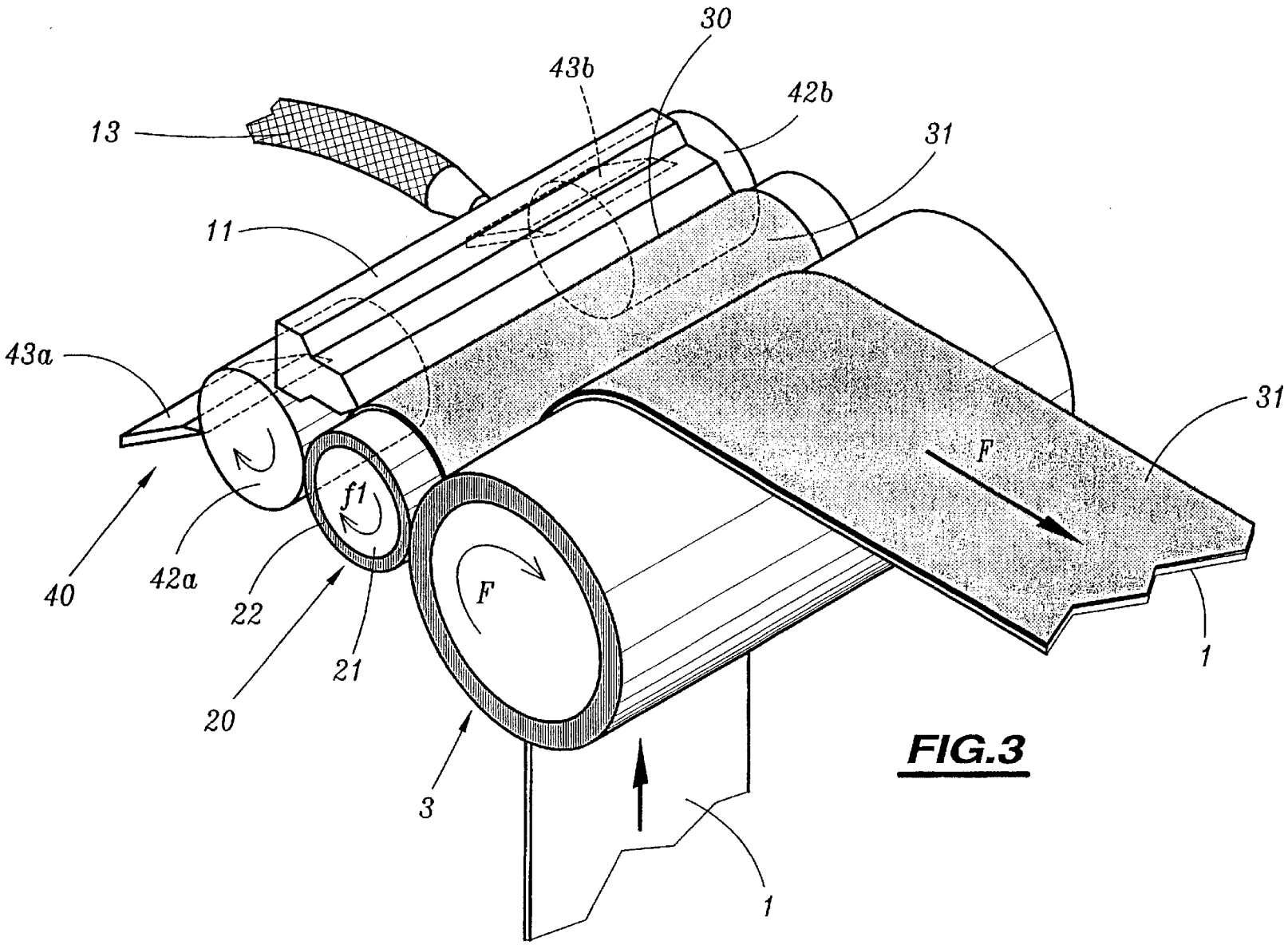
FIG. 3 is a schematic perspective view of the application apparatus according to the invention and provided with a second embodiment of means for removing the excess crosslinkable polymer.

The applicator roll 20 is heated to a temperature approximately equal to or greater than, on the one hand, the formation temperature of the sheet 30 and, on the other hand, the softening temperature of the crosslinkable polymer and is driven in rotation, by suitable means, not shown, in the opposite directon to the one in which the metal strip runs, as shown by the arrows f1 in FIGS. 2 and 3.

The applicator roll 20 is driven in rotation, with respect to the back-up roll 3 for supporting the said metal strip 1, in the same direction as this roll 3.

The sheet 30 of the said crosslinkable polymer is formed, for example, by extrusion coating or by extrusion lamination.

In the case of extrusion coating as shown in FIGS. 2 and 3, the means for forming the sheet 30 by forced flow are formed by the die 11 bearing against the surface of the applicator roll 20 and provided with means, of the conventional type, for adjusting the position of the edges of the extrusion slot 12 of the said die 11 with respect to the said surface of the applicator roll 20.

The die 11 of the extruder provides the uniform distribution of the sheet 30, which is obtained by varying the output from the die 11 and the speed of rotation of the applicator roll 20.

The die 11 is pressed against the applicator roll 20, for example by means of cylinders (not shown), the pressure of which makes it possible to make the leakage rate of the fluid crosslinkable polymer uniform.

Because of the strict parallelism between the die 11 and the applicator roll 20, a sheet 30 of uniform thickness is formed on the latter.

In the case of extrusion lamination, the means for forming the sheet 30 by forced flow are formed by the die 11, means for drawing the sheet 30 by adjusting the output from this die 11 and/or by adjusting the speed of rotation of the applicator roll 20, means, of conventional type, for adjusting the position of the edges of the extrusion slot 12 of the said die 11 with respect to the surface of the pinch roll 20 and by means, not shown, for pressing the sheet 30 against the said surface of the applicator roll 20.

The means for pressing the sheet 30 against the surface of the applicator roll 20 are formed for example by an air knife, directed towards the applicator roll 20 along the contact generatrix of the n said sheet 30 on the said applicator roll 20.

The internal heating system consists, for example, of electrical resistance elements embedded in the core of the applicator roll 20 or by channels made in the said core for the circulation of a fluid, such as oil for example.

The internal temperature of the applicator roll 20 must be controlled, such as for example by means of a thermocouple (not shown), so as not to exceed a limiting value in order to prevent the external jacket 22 of deformable material from being damaged by too high a temperature and causing deterioration to the bonding layer between the deformable material and the metal core of the said applicator roll 20.

The coating apparatus 10 also includes means, not shown, for adjusting the contact pressure between the applicator roll 20 and the metal strip 1.

These means consist, for example, of hydraulic cylinders or screw-nut systems and make it possible to adjust this contact pressure according to the viscosity of the crosslinkable polymer so as to ensure total transfer of the material and to minimize the friction forces.

As shown in FIGS. 2 and 3, the extrusion slot 12 of the die 11 and the applicator roll 20 have a length greater than the width of the metal strip 1 so as to coat the entire surface of the face of this metal strip 1 which is in contact with the applicator roll 20.

According to a variant, the extrusion slot 12 of the die 11 and the applicator roll 20 may have a length less than the width of the metal strip 1 in order to coat only part of the surface of the face of the said metal strip 1 in contact with the applicator roll 20.

The thin fluid film 31 of thermally or physically crosslinkable polymer is applied in the following manner.

The metal strip 1 is maintained at a temperature equal to or greater than the softening temperature of the crosslinkable polymer and the applicator roll 20 is driven in rotation in the opposite direction to the direction in which this metal strip 1 runs.

By way of example, the metal strip 1 is preheated to a temperature of 140° C. immediately before it passes onto the back-up roll 3, and it runs at a speed of 30 m/min.

At the exit of the die 11 of the extruder, the sheet 30 formed by forced flow at a temperature higher than the softening temperature of the polymer is pressed against the applicator roll 20 so as to form the film 31 of crosslinkable polymer with a uniform thickness corresponding approximately to the thickness of the coating to be formed on the metal strip 1.

By way of example, the extrusion slot 12 of the die 11 has an opening of 300 $\mu$m in height, adjusted by a metal insert over an application width of 350 mm. This die 11 is pressed against the applicator roll 20, for example by means of cylinders whose pressure can be adjusted and allows the output of the crosslinkable polymer to be made uniform.

Because of the pressure exerted on the metal strip 1 by the applicator roll 20 and the back-up roll 3 having a deformable surface, all of the film 31 is transferred from the applicator roll 20 onto the surface of the metal strip 1 to be coated.

Next, the metal strip thus coated passes through the means 5 for curing the film 31 of crosslinkable polymer and then through the means 6 for cooling the said film 31.

This film 31 of crosslinkable polymer may be deposited on a bare metal strip, made of steel or aluminium or aluminium alloy, or on a metal strip precoated or prepainted on one or both sides.

The coating thus produced on the metal strip 1 has, for example, a thickness of between 5 and 100 $\mu$m with a thickness uniformity of a few microns, despite the appreciable discrepancies in the flatness or thickness heterogeneity of the metal strip 1.

Other means for forming the sheet 30 by forced flow may be used.

Thus, the means for forming the sheet 30 by forced flow may be formed by a system for spraying a fluid crosslinkable polymer onto the applicator roll 20 or by a system for applying, against this applicator roll 20, a continuous web of crosslinkable polymer produced beforehand in order to form the sheet 30.

The sheet 30 and the film 31 of crosslinkable polymer may have a width of less than the width of the metal strip 1 in order to coat part of this metal strip 1 or a width greater than the width of this metal strip 1 in order to coat the said metal strip 1 in its entirety.

If the sheet 30 and the film 31 have a width greater than the metal strip 1, as shown in FIGS. 2 and 3, there is, on either side of the useful zone of application to the said metal strip 1, a portion of crosslinkable polymer which is not applied to this metal strip 1.

This excess crosslinkable polymer has to be removed so as to prevent it from creating an additional thickness on the applicator roll 20.

To do this, the coating apparatus is equipped with means 40 for removing the excess crosslinkable polymer deposited on the applicator roll 20.

According to a first embodiment shown in FIG. 2, the means 40 for removing the excess crosslinkable polymer deposited on the applicator roll 20 are formed by two scrapers, respectively 41*a* and 41*b*, for example made of metal, in contact with the applicator roll 20 in each region located outside that region of the said applicator roll 20 which is in contact with the metal strip 1.

The scrapers 41*a* and 41*b* are in contact with the applicator roll 20 upstream of the generatrix for applying the sheet 30 to this applicator roll 20 with respect to the direction of rotation of the said applicator roll 20.

The transverse position of the scrapers 41*a* and 41*b* on the applicator roll 20 can be slaved, by suitable means, not shown, to the width of the metal strip and/or to the transverse position of this metal strip 1 on the back-up roll 3.

This is because the position of this metal strip 1 on this back-up roll 3 may vary.

The scrapers 41*a* and 41*b* are therefore in contact with the applicator roll 20 and remove the excess crosslinkable polymer by rubbing against the said roll 20.

According to a variant shown in FIG. 3, the means 40 for removing the excess crosslinkable polymer on the applicator roll 20 are formed, on the one hand, by two recovery rolls, respectively 42*a* and 42*b*, having a hard surface, for example made of metal, in contact with the applicator roll 20 in each region located outside that region of the said applicator roll 20 which is in contact with the metal strip 1 and, on the other hand, by two scrapers, respectively 43*a* and 43*b*, for example made of metal, each in contact with a recovery roll 42*a* and 42*b*.

The recovery rolls 42*a* and 42*b* are driven in rotation in the same direction as the applicator roll 20 and are optionally cooled.

According to yet another variant, the means for removing the excess crosslinkable polymer on the applicator roll 20 are formed, on the one hand, by an optionally cooled recovery roll, having a hard surface, for example made of metal, in contact with the applicator roll 20 and, on the other hand, by a scraper, for example made of metal, in contact with the recovery roll. In this case, the recovery roll and the scraper have a length at least equal to the length of the applicator roll 20.

Thus, the excess crosslinkable polymer deposited on the applicator roll 20 on each side of the application area of this crosslinkable polymer on the metal strip 1 is transferred onto the recovery rolls 42*a* and 42*b* and this excess crosslinkable polymer is removed from the recovery rolls 42*a* and 42*b* by the scrapers 43*a* and 43*b*.

The means for removing the excess crosslinkable polymer deposited on the applicator roll 20 avoid having to add inserts into the slot 12 of the extrusion die 11 so as to size the sheet 30 of crosslinkable polymer as soon as it leaves the die 11 and to accommodate variations in the width and transverse positioning of the metal strip 1 within the predefined tolerance limits.

According to a variant, both sides of the metal strip 1 may be coated with a film 31 of crosslinkable polymer.

In this case, an apparatus 10 for applying the film 31 is placed on one side of the metal strip 1 and another apparatus 10 for applying the film 31 is placed on the other side of the said metal strip 1.

Application of the film 31 to each side of the metal strip 1 may be offset or simultaneous. For simultaneous application, the back-up roll 3 is omitted and replaced with an applicator roll of the second application apparatus. The applicator roll of each apparatus forms a back-up roll for the metal strip.

Moreover, the transverse position of the extrusion die 11 may be permanently centred with respect to the metal strip 1 by placing this extrusion die 11 on a support which can move transversely and by connecting this die to the extruder via a hose 13 which makes it possible to slave the position of this extrusion die 11 with respect to the metal strip 1 according to the variations in the transverse position of the said metal strip 1 with respect to the back-up roll 3.

According to yet another variant, a lubricant may be deposited on the applicator roll 20 outside the region in contact with the metal strip 1 so as to facilitate the operation of the scrapers 41*a* and 41*b* for removing the excess crosslinkable polymer.

By way of example, the crosslinkable polymer compound is formulated as follows:

85% by weight of a polyester polyol called URALAC P1460 from DSM Resins (The Netherlands) having the following characteristics:

average number of —OH per molecule: $F_{OHav}=3$ hydroxyl number of the polyol: $I_{OH}=37$ to 47 average molar mass (by weight) $M_w=20{,}000$ g/mol average molar mass (in terms of number of molecule) $M_n=4090$ polydispersity index $M_w/M_n$: $I_p=4.9$ (the hydroxyl number of the polyol, $I_{OH}$, being defined as the necessary amount of potassium— in mg— to neutralize all the hydroxyl functional groups; therefore:

$$F_{OH,av}=I_{OH}\times M_n/56100);$$

as hardener, 15% by weight of a blocked isocyanate called VESTAGON BF 1540 from HÜLS, essentially consisting of IPDI uretidione;

average number of —NCO per molecule: $F_{iso:av}=2$ melting point between 105° C. and 115° C.

crosslinking deblocking temperature=160° C.

total amount of NCO radicals=14.7 to 16% by weight proportion of free (unblocked) NCO radicals<1% by weight;

viscosity for a shear rate of 10 $s^{-1}$:

at 120° C.: 900 Pa.s at 130° C.: 400 Pa.s at 140° C.: 180 Pa.s at 150° C.: 80 Pa.s.

This compound is entirely in the fluid and/or viscous state above a temperature of 120° C. and its rapid-crosslinking temperature is between 170° C. and 250° C.

The crosslinkable polymer may also be pigmented and filled, for example to 40% by weight and higher, with titanium oxide.

The coating apparatus according to the invention makes it possible, by the use of an applicator roll having a deformable surface, to obtain a coating of crosslinkable polymer with a uniform thickness of, for example, between 5 and 50 $\mu$m and applied homogeneously to a metal strip exhibiting significant roughness of amplitude comparable to the thickness of the film, by means of the perfect contact between the applicator roll and the surface of the metal strip to be coated, despite the discrepancies in flatness and in thickness heterogeneity of the metal strip.

The speed of the applicator roll may be adjusted to a level substantially greater than the speed at which the metal, strip runs so as to obtain perfect continuity of the coating and an excellent surface finish of this coating of crosslinkable polymer transferred to this metal strip. The tangential speed of the applicator roll (20) is adjusted so as to be in a ratio of between 0.5 and 2 times the speed at which the metal strip (1) runs.

Moreover, the surface energy of the external jacket of deformable material of the applicator roll is matched to the crosslinkable polymer in order to allow the sheet to be correctly spread over this applicator roll.

The coating apparatus according to the invention may also be used for a downward or horizontal metal strip.

The fact that the temperature of formation of the sheet is below the crosslinking temperature of the polymer is an important characteristic in the case of thermosetting polymers since the forced flow through an extrusion slot involves significant stagnation of the polymer which is necessary for good distribution of this polymer over the entire width of this extrusion slot and there must be no risk of crosslinking of the said polymer therein.

Moreover, the coating apparatus according to the invention makes it possible to be able to continuously coat metal strips of different widths and to simultaneously coat several metal strips placed parallel to each other and to overcome the problem of fluctuations in the width and transverse positioning of the metal strip or strips by simple and effective means.

The coating apparatus according to the present invention makes it easier for the coating of crosslinkable polymer to be fed in a regular and uniform manner by selecting the feed mode best suited, depending on the product to be employed.

The advantage of this wide choice is particularly great in the case of highly reactive thermosetting coatings which cannot be fed at a high temperature close to the reactivity range.

This apparatus also makes it possible, in the case of a chemical crosslinking process, to raise the temperature of the coating of crosslinkable polymer so as to reduce its viscosity and make it easier for it to be transferred onto and spread out over the metal strip.

This is because the temperature of the material delivered by the feed system located upstream of the pinch roll is limited to a value below that of the onset of crosslinking in order to avoid any risk of evolution from the product in the feed system.

Because of this temperature limitation, it is impossible to reduce the viscosity of the product to a level low enough to make it easier to transfer it onto and properly spread it out over the metal strip. During contact with the heated rolls, the material to be transferred undergoes very considerable heating but only for a very short time, thereby avoiding any risk of crosslinking of the product at this point.

Finally, the apparatus according to the invention makes it possible to compensate for fluctuations in width or in transverse position of the metal strip during the application and to get round the problems of lack of uniformity of the metal strip and to produce a surface coating of uniform thickness on a non-uniform metal substrate.

What is claimed is:

1. Process for the continuous coating of at least one metal strip (1) with a fluid film (31) of crosslinkable polymer containing neither non-reactive solvent nor diluent, the said film (31) having a thickness of less than that of the metal strip (1), characterized in that:

the metal strip (1) is made to run continuously over at least one back-up roll (3);

a sheet (30) of the said crosslinkable polymer is formed, by forced flow at a temperature above the softening temperature of the crosslinkable polymer, on an applicator roll (20) having a deformable surface, the said crosslinkable polymer having a melt viscosity greater than 10 Pa.s under the conditions of formation of the said sheet, the temperature of formation of this sheet (30) being below the crosslinking onset temperature of the crosslinkable polymer and the said applicator roll (20) being driven, in rotation in the opposite direction to the direction in which the metal strip (1) runs at a point of contact between the applicator roll and the metal strip; the crosslinkable polymer film (31) is formed 25 on the applicator roll (20);

the film (31) is transferred, thicknesswise, from the applicator roll onto the metal strip (1), by compressing this metal strip between the back-up roll (3) and the applicator roll (20), in order to obtain a coating of homogeneous thickness.

2. Coating process according to claim 1, characterized in that the metal.strip (1) is preheated to a temperature approximately equal to or greater than the temperature of the crosslinkable polymer film (31) and the softening temperature of this crosslinkable polymer.

3. Coating process according to claim 1, characterized in that the applicator roll (20) is heated to a temperature approximately equal to or greater than the temperature of formation of the sheet (30) and the softening temperature of this crosslinkable polymer.

4. Coating process according to claim 1, characterized in that the sheet (30) is formed by extrusion coating.

5. Coating process according to claim 1, characterized in that the sheet (30) is formed by extrusion lamination.

6. Coating process according to claim 1, characterized in that the sheet (30) is formned by spraying a crosslinkable fluid polymer onto the applicator roll (20).

7. Coating process according to claim 1, characterized in that the sheet (30) is formed on the applicator roll (20) from a continuous web of crosslinkable polymer produced beforehand.

8. Coating process according to claim 1, characterized in that the internal temperature of the applicator roll (20) is adjusted in order to prevent the deformable surface of this applicator roll (20) from being damaged.

9. Coating process according to claims 1, characterized in that the tangential speed of the applicator roll (20) is adjusted so as to be in a ratio of between 0.5 and 2 times the speed at which the metal strip (1) runs.

10. Coating process according to claim 1, charactrized in that the sheet (30) and the film (31) of fluid crosslinkable polymer are formed with a width of less than the width of the metal strip (1) in order to coat only part of this metal strip (1).

11. Coating process according to claim 1, characterized in that the sheet (30) and the film (31) of fluid crosslinkable polymer are formed with a width greater than the width of the metal strip (1) in order to coat this metal strip (1) in its entirety.

12. Coating process according to claim 1, characterized in that the crosslinkable polymer deposited in excess on the applicator roll (20) is removed.

13. Coating process according to claim 1, characterized in that a lubricant is deposited on the applicator roll (20) on the outside of the region in contact with the metal strip (1).

14. Apparatus for the continuous coating of at least one metal strip (1) with a fluid film (31) of crosslinkable polymer containing neither non-reactive solvent nor diluent, the said film (31) having a thickness of less than that of the metal strip (1), characterized in that it comprises:

means for continuously driving the metal strip (1);

at least one back-up roll (3) supporting the metal strip (1);

means (11, 12) for forming, on an applicator roll (20) having a deformable surface, by forced flow at a temperature greater than the softening temperature of the crosslinkable polymer, a sheet (30) of the said crosslinkable polymer having a melt viscosity greater than 10 Pa.s under the conditions of formation of the said sheet, the formation temperature of this sheet (30) being below the crossslinking onset temperature of the crosslinkable polymer, and the said applicator roll (20) being driven in rotation, in the opposite direction to the direction in which the metal strip (1) runs at a point of contact between said applicator roll and said metal strip, and forming the crosslinkable polymer film (31); and means for compressing the metal strip between the back-up roll (3) and the applicator roll (20) in order to completely transfer, thicknesswise, the said film (31) from the applicator roll (20) onto the metal strip (1) and to obtain a coating of homogeneous thickness.

15. Coating apparatus according to claim 14, characterized in that it comprises means for preheating the metal strip (1) to a temperature equal to or greater than the temperature of the crosslinkable polymer film (31) and the softening temperature of this crosslinkable polymer.

16. Coating apparatus according to claim 14, characterized in that it comprises means for heating the applicator roll (20) to a temperature approximately equal to or greater than the temperature of formation of the sheet (30) and the softening temperature of this crosslinkable polymer.

17. Coating apparatus according to claim 14, characterized in that the means for forming the sheet (30) by forced flow comprise an extruder fitted with a die (11) having an extrusion slot (12) and a flow regulator placed between the extruder and the die (11).

18. Coating apparatus according to claim 14, characterized in that the means for forming the sheet (30) by forced flow are formed by the die (11) bearing against the surface of the applicator roll (20) and provided with means for adjusting the position of the edges of the extrusion slot (12) of the said die (11) with respect to the surface of the applicator roll (20).

19. Coating apparatus according to claim 14, characterized in that the means for forming the sheet (30) by forced flow are formed by the die (11), means for drawing the sheet (30) by adjusting the output from the die (11) and/or by adjusting the speed of rotation of the applicator roll (20), means for adjusting the position of the edges of the extrusion slot (12) of the said die (11) with respect to the surface of the applicator roll (20) and by means for pressing the sheet (30) against the said surface of the applicator roll (20).

20. Coating apparatus according to claim 14, characterized in that the means for forming the sheet (30) by forced flow are formed by a system for spraying the fluid crosslinkable polymer onto the applicator roll (20) in order to form the said sheet (30).

21. Coating apparatus according to claim 14, characterized in that the means for forming the sheet (30) by forced flow are formed by a system for applying a continuous web of crosslinkable polymer, produced beforehand in order to form the said sheet (30), to the applicator roll (20).

22. Coating apparatus according to claim 14, characterized in that it comprises means for adjusting the internal temperature of the applicator roll (20) in order to prevent the external jacket (22) of deformable material of this applicator roll (20) from being damaged.

23. Coating apparatus according to claim 14, characterized in that it comprises means for adjusting the tangential speed of the applicator roll (20) in a ratio of between 0.5 and 2 times the speed at which the metal strip (1) runs.

24. Coating apparatus according to claim 14, characterized in that the means for pressing the sheet (30) against the applicator roll (20) comprise an air knife directed onto the applicator roll (20) along the contact generatrix of the said sheet (30) on the said applicator roll (20).

25. Coating apparatus according to claim 14, characterized in that the sheet (30) and the film (31) of fluid crosslinkable polymer have a width of less than the width of the metal strip (1) in order to coat only part of this metal strip (1).

26. Coating apparatus according to claim 14, characterized in that the sheet (30) and the film (31) of fluid crosslinkable polymer have a width of greater than the width of the metal strip (1) in order to coat this metal strip (1) in its entirety.

27. Coating apparatus according to claim 14, characterized in that it includes means (40) for removing the excess crosslinkable polymer deposited on the applicator roll (20).

28. Coating apparatus according to claim 27, characterized in that the removal means (40) are formed by at least one scraper (41*a*, 41*b*) in contact with the applicator roll (20) in each region located outside that region of the said applicator roll (20) which is in contact with the metal strip (1).

29. Coating apparatus according to claim 27, characterized in that the removal means (40) are formed, on the one hand, by at least one recovery roll (42*a*, 42*b*) having a hard surface, in contact with the applicator roll (20) in each region located outside that region of the said applicator roll (20) which is in contact with the metal strip (1), the said recovery roll being driven in rotation in the same direction as this applicator roll (20), and, on the other hand, by at least one scraper (43*a*, 43*b*) in contact with each recovery roll (42*a*, 42*b*).

* * * * *